United States Patent [19]

Bills

[11] Patent Number: 4,802,249

[45] Date of Patent: Feb. 7, 1989

[54] PORTABLE MULTIPLE SECTION ADJUSTABLE POSTURE CONTOUR CARE BED

[76] Inventor: Earl C. Bills, P.O. Box 365, Savoy, Tex. 75479

[21] Appl. No.: 157,590

[22] Filed: Feb. 19, 1988

[51] Int. Cl.[4] ..... A47C 20/00; A47C 27/00

[52] U.S. Cl. ..... 5/420; 5/431; 5/465

[58] Field of Search ..... 5/417, 419, 420, 431, 5/432, 436, 437, 446, 448, 465; 297/DIG. 6

[56] References Cited

U.S. PATENT DOCUMENTS

| | | | |
|---|---|---|---|
| 2,105,319 | 1/1938 | Hedden et al. | 5/419 X |
| 2,857,957 | 10/1958 | Gay | 5/420 X |
| 3,222,694 | 12/1965 | Schick | 5/431 |
| 3,775,785 | 12/1973 | Mittendorf | 5/465 X |
| 4,171,549 | 10/1979 | Morrell et al. | 5/465 |
| 4,397,052 | 8/1983 | Lund, III | 5/431 |
| 4,473,913 | 10/1984 | Ylvisaker | 5/465 X |
| 4,506,396 | 3/1905 | Ritchie, Jr. et al. | 5/431 |

FOREIGN PATENT DOCUMENTS

| | | | |
|---|---|---|---|
| 546541 | 4/1956 | Belgium | 5/465 |
| 1065909 | 4/1967 | United Kingdom | 5/446 |
| 1391506 | 4/1975 | United Kingdom | 5/465 |

*Primary Examiner*—Gary L. Smith
*Assistant Examiner*—Michael F. Trettel
*Attorney, Agent, or Firm*—Warren H. Kintzinger

[57] ABSTRACT

A three piece portable adjustable length posture care bed or hospital bed with one a rectangular cushion and the other two rectangular in profile yet wedged shaped to better conform to a user's body when used as bed. When the two wedged shaped cushions are properly placed together along with the third cushion they fit within a carrying case weighing altogether not more than approximately ten pounds. One of the wedge cushions includes a cloth extension that is positionable to underlie the thin end of the other wedge cushion and that permits varied spacing of the wedge cushions in adapting to the height of a user. The cushions are maintained in the desired assembled spaced relation via criss-cross VELCRO interlocking fastening strips that allow great versatility in use.

10 Claims, 3 Drawing Sheets

PORTABLE MULTIPLE SECTION ADJUSTABLE POSTURE CONTOUR CARE BED

Figure 1:
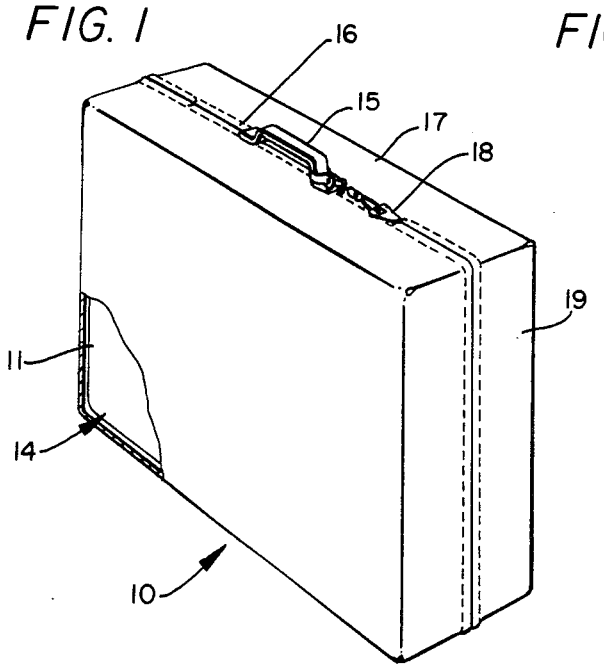

This invention relates in general to special care bedding, and more particularly, to an adjustable length portable multi-section cushion posture care bed and a suit case shaped carrying case that altogether weighs not more than approximately ten pounds.

Many people with injuries, bad backs and/or posture problems have trouble resting in a conventional flat mattressed bed and just do not sleep properly. Some are driven to even bringing hospital type adjustable contour beds that, however, are not only expensive, but ackward to move and/or adjust and simply not suited for taking along on a trip. Further, people vary in height and geometry making it difficult for one bed even an adjustable hospital bed to be universally useable for one and all. In order to be feasable for use on a trip a multiple cushion care bed must be placeable together in a compact light weight package enclosed in a suit case like carrier to take along on a plane, train, bus or car.

It is therefore a principal object of this invention to provide a portable multiple section posture contour care bed.

Another object is to provide such a care bed that is adjustable in length to adapt for people of different heights and shapes.

A further object is to provide such a care bed packageable to a light rectangular package encloseable in a suitcase type carrying case.

Still another object is to provide such a care bed useable on hotel and motel beds, in the home and even on the floor.

Another object is to provide such a care bed that is economical, easy to store, and easy to keep clean.

Features of the invention useful in accomplishing the above objects include, in a portable multiple section adjustable posture contour care bed packageable for enclosure in a suitcase like carrying case, a three piece adjustable length bed with one piece a rectangular cushion and the other two pieces rectangular in profile yet wedge shaped for optomized conformation to a user's body when used as a bed. The three pieces are formed of molded foam rubber, or like resiliently compressible material, and are individually encased in zipper closed like shaped sheet material enclosures that are easily removed from the pieces for laundering as needed. When the two wedged shaped cushions are properly placed together along with the third cushion they fit within a carrying case altogther weighing not more than approximately ten pounds. One of the wedge cushions includes a cloth extension that is positionable to underlie the thin end of the other wedge cushion and that permits varied spacing of the wedge cushions in adapting to the height of a user. The cushions are maintained in the desired assembled spaced relation via crisscross velcro interlocking fastening strips that allow great versatility in use.

A specific embodiment representing what is presently regarded as the best mode of carrying out the invention is illustrated in the accompanying drawings.

Figure 2:
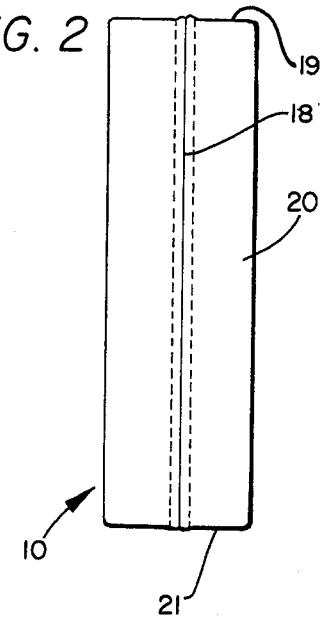
Figure 3:
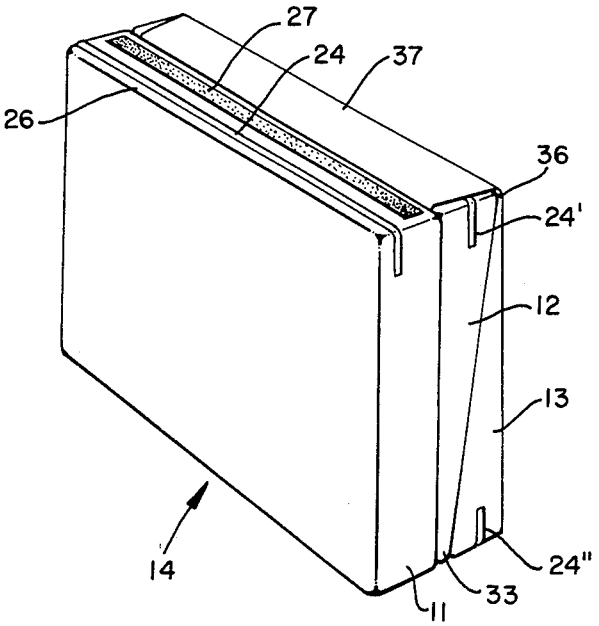
Figure 4:
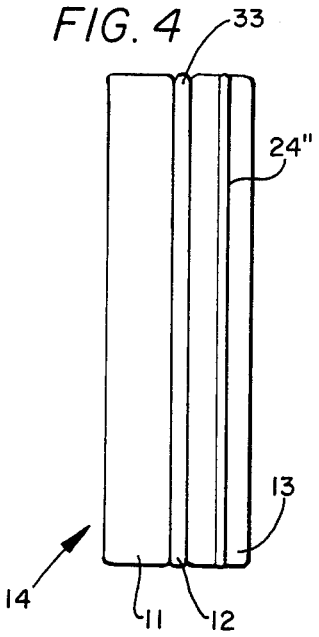
Figure 5:
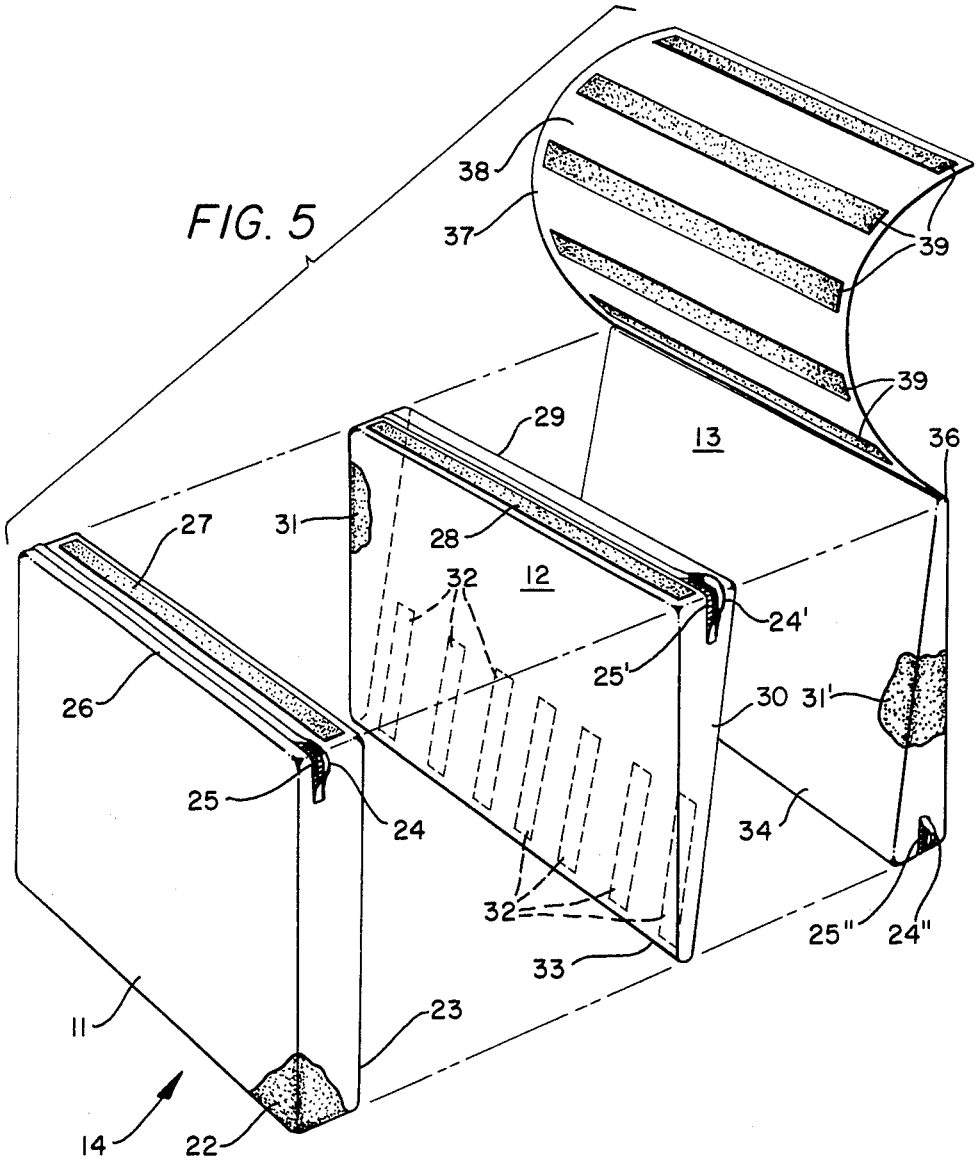
Figure 6:
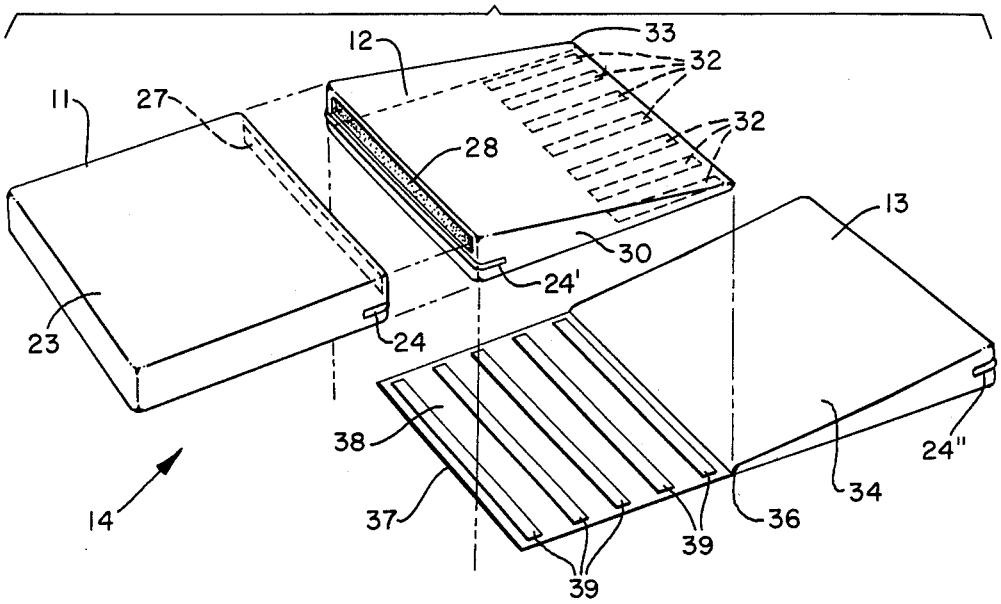
Figure 7:
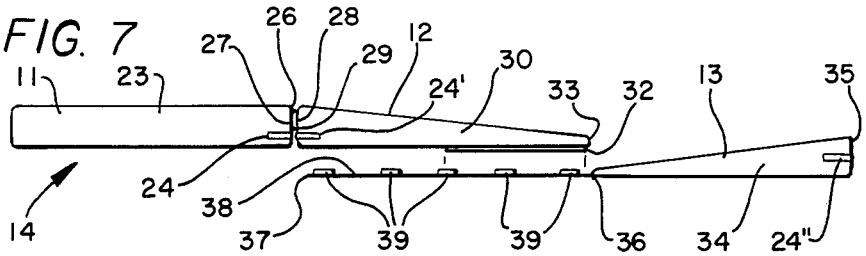
Figure 8:
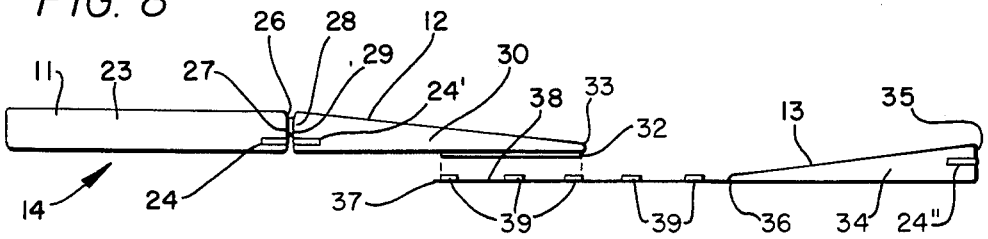

In the drawings:

FIG. 1 represents a perspective view of a suitcase type carrier with a bed packaged in rectangular form contained therein:

FIG. 2, a bottom view of the carrying case of FIG. 1;

FIG. 3, a perspective view of the three piece care bed packaged for insertion in the carrying case of FIGS. 1 and 2;

FIG. 4, a bottom view of the three piece care bed as packaged in FIG. 3;

FIG. 5, an exploded perspective view of the three piece care bed positioned for packaging together to the packaged state of FIG. 3, with, however, more section detail shown;

FIG. 6, a three section separated (exploded) view with the three pieces positioned for assembly together; and FIGS. 7 and 8, side elevation views of the three piece care bed illustrating positioning respectively for the shortest bed length assembly and a long bed length.

Referring to the drawings:

A rectangular shaped carrying case 10 is shown in FIGS. 1 and 2 that encloses a three cushion 11, 12 and 13 bed 14 shown in the rectangular packaged form in FIGS. 3 and 4 for insertion in the carrying case 10. The bed carrying case 10 has a handle 15 at the middle section 16 of the case top 17 and a zipper 18 that runs from one end of middle section 16 to and down case end 19 through the case bottom 20, up case end 21 and back to an end of the case middle section 16.

Referring also to FIGS. 5 and 6 cushion 11 is shown to include a foam rubber insert 22 (or its resiliently compressible fire retardant plastic equivalent) molded to a rectangular shape both plan view wise and end view (or cross section) wise encased within sheet material enclosure 23 equipped with a flap 24 concealed zipper 25 across one end 26 and around the edge corners. Part of the sheet material enclosure 23 is removed showing the foam rubber insert 22 and a portion of flap 24 is lifted back exposing the zipper 25. The sheet material enclosure 23 is also provided with a Velcro interlocking material strip 27, that extends across end 26 substantially the length thereof, and that is engageable with, in interlocking relationship, a mating strip 28 of Velcro interlocking material that is mounted on the rectangular face end 29 of the sheet material enclosure 30 of cushion 12. Cushion 12 is shown to include a wedge shaped foam rubber insert 31 (or its resiliently compressible first retardant plastic equivalent) molded to a rectangular shape in plan view and a wedge shape in side edge view that is encased within the wedge shaped sheet material enclosure 30. Enclosure 30 is also equipped with a flap 24' concealed zipper 25' across end 29 and around the edge corners and, on the bottom a plurality of spaced parallel strips 32 of one of the mating sides of Velcro interlocking material running from the narrow edge 33 of the wedge shaped cushion 12 to approaching half the distance to rectangular face end 29.

The third cushion 13, also a wedge shaped cushion, is shown to include a wedge shaped foam rubber insert 31', that can be the same molded shape as insert 31, rectangular in plan view and wedge shaped in side edge view that is encased within the wedge shaped sheet material enclosure 34. Enclosure 34 is equipped with a flap 24'' concealed zipper 25'' across end 35 and around the edge corners, and at the narrow edge 36 of the wedge shaped cushion 13 an extension flap 37 that extends approximately the length of wedge shaped cushion 12. The extension flap 37 mounts on its upper face 38 a plurality of spaced parallel Velcro interlocking material strips 39 of the opposite mating side from strips 32 so as to interlock when placed together. The three cushions 11, 12 and 13 are substantially the same size in plan view to facilitate packaging thereof through the state of FIG. 5 to the package assembled state of FIGS. 3 and 4 for enclosure within the carrying case 10. This is with the extension flap 37 of wedge shaped cushion 13 folded over the rectangular face end 29 of enclosure 30 (i.e. the thick end 26 of the cushion wedge shape). It should be noted that the mating strips of Velcro interlocking material and 28 of cushions 11 and 12, respectively, are across the top of cushion ends 26 and 29 above the zippers 25 and 25', respectively.

Referring also to FIGS. 7 and 8 the Velcro interlocking material strips 39 extend transverseally across from side to side on the top face 38 of extension flap 37 to facilitate the bed cushions 12 and 13 being brought together as indicated in FIG. 7 for the short torso individual, or being brought together as indicated in FIG. 8 for the tall individual with an infinite number of individual length adjustments between the limits shown. A user lies on the bed with his head on cushion 13 adjacent large end 35, buttocks in the narrow edge areas of wedge cushions 12 and 13, and legs extending from cushion 12 to over cushion 11 with the feet over cushion 11.

Whereas this invention has been described with respect to a single embodiment thereof, it should be realized that various changes may be made without departure from the essential contributions made by the teachings hereof.

I claim:

1. A multiple section adjustable posture contour care bed comprising: a plurality of cushions including two wedge shaped cushions each rectangular in plan view and wedge shaped in side edge view extending from a wide end to a thin edge; extension flap means having a top face extending from the thin edge of a first cushion of said two wedge shaped cushions for a length approximately the length of one of said wedge shaped cushions; an area contact interlocking material positioned on the top face of said extension flap means; and a second contact interlocking material that position locks on contact with said contact interlocking material on the top face of said extension flap means with said second contact interlocking material mounted on the bottom of the second cushion of said two wedge shaped cushions extending from the thin edge of the cushion back for a distance under the cushion to facilitate placement of the second cushion at various spacings from the first cushion in adapting to the height of a user; and wherein a third cushion is included in said plurality of cushions that is generally of rectangular shape both plan view wise and side end view wise, and that has rectangular forward and rear faces; and fastening means on the forward face of said third cushion engageable in interlocking relation with fastening means positioned on the wide end of one of said wedge shaped cushions.

2. The multiple section adjustable posture contour care bed of claim 1, wherein the three cushions, the two wedge shaped cushions and the third cushion, are all substantially the same size in plan view so that said third cushion placed side by side with said two wedge shaped cushions nested together one inverted relative to the other they form together a generally rectangular package top view wise side view wise and end view wise.

3. The multiple section adjustable posture contour care bed of claim 2, wherein a suitcase like carrying case is provided capable of receiving and enclosing the three cushion rectangular package.

4. The multiple section adjustable posture contour care bed of claim 3, wherein said carrying case has a top section mounting a handle; and a zipper case closer extending from said top section down one end of the case, across the bottom of the case from end to end, up the other end of the case and back to said top section.

5. The multiple section adjustable posture contour care bed of claim 1, wherein said area of contact interlocking material positioned on the top face of said extension flap means has portions adjacent the thin edge of the cushion the extension flap extends from and adjacent to the far end of said extrusion flap; wherein said contact interlocking material positioned on the top face of said extension flap is in the form of spaced parallel strips of contact interlocking material; said second contact interlocking material mounted on the bottom of the second cushion of said two wedge shaped cushions is in the form of spaced parallel strips of said second contact interlocking material on the bottom of the second cushion through an area extending back from the thin edge of the second cushion to the mid region of the cushion so that when the second cushion is placed on the extension flap of the first cushion there are criss cross areas of interlocking contact between the strips of contact interlocking material on the top face of said extension flap means and strips of said second contact interlocking material on the bottom of said second cushion; each of said cushions includes, an inner resiliently compressible material member; and a cloth enclosure shaped to receive the inner resiliently compressible material member of the respective cushion; zippered openings are provided in said cloth enclosures for insertion of and removal of said resiliently compressible material members to facilitate cleaning of the cloth cushion enclosures; and wherein the fastening means on the forward face of said third cushion is above the cushion cover zippered opening that is located therebelow on the forward face of said third cushion; and with fastening means on the wide end of one of said wedged shaped cushions being above the zippered opening that is located therebelow on the wide end of the cover of that wedge shaped cushion.

6. The multiple section adjustable posture contour care bed of claim 5, wherein said resiliently compressible material members are molded from fire retardent material.

7. A multiple section adjustable posture contour bed comprising: a plurality of cushions including two wedge shaped cushions each rectangular in plan view and wedge shaped in side edge view extending from a wide end to a thin edge; extension flap means having a top face extending from the thin edge of a first cushion of said two wedge shaped cushions for a length approximately the length of one of said wedge shaped cushions; an area of contact interlocking material positioned on the top face of said extension flap means; and a second contact interlocking material on the top face of said extension flap means with said second contact interlocking material mounted on the bottom of the second cushion of said two wedge shaped cushions extending from the thin edge of the cushion back for a distance under the cushion to facilitate placement of the second cushion at various spacings from the first cushion in adapting to the height of a user; wherein said area of contact interlocking material positioned on the top face of said extension flap means has portions adjacent the thin edge of the cushion the extension flap extends from and adjacent to the far end of said extension flap; said contact interlocking material positioned on the top face of said extension flap is in the form of spaced parallel strips of contact interlocking material; said spaced parallel strips of contact interlocking material extend transversely across the top of said extension flap; said second contact interlocking material mounted on the bottom of the second cushion of said two wedged shaped cushions is in the form of spaced parallel strips of said second contact interlocking material on the bottom of the second cushion extending back from the thin edge of the second cushion to the mid region of the cushion so that when the second cushion is placed on the extension flap of the first cushion there are criss cross areas of interlocking contact between the strips of contact interlocking material on the top face of said extension flap means and strips of said second contact interlocking material on the bottom of said second cushion; and wherein a third cushion is included in said plurality of cushions that is generally of rectangular shape both plan view wise and side end view wise, and that has rectangular forward and rear faces; and fastening means on the forward face of said third cushion engageable in interlocking relation with fastening means positioned on the wide end of one of said wedge shaped cushions.

8. The multiple section adjustable posture contour care bed of claim 7, wherein the three cushions, the two wedge shaped cushions and the third cushion, are all substantially the same size in plan view so that said third cushion placed side by side with two wedge shaped cushions nested togther one inverted relative to the other they form together a generally rectangular package top view wise, side view wise and end view wise.

9. The multiple section adjustable posture contour care bed of claim 8, wherein a suitcase like carrying case is provided capable of receiving and enclosing the three cushions rectangular package.

10. The multiple section adjustable posture contour care bed of claim 9, wherein said carrying case has a top section mounting a handle; and a zipper case closer extending from said top section down one end of the case, across the bottom of the case from end to end, up the other end of the case and back to said top section.

* * * * *